US009757606B2

(12) United States Patent
Hao

(10) Patent No.: US 9,757,606 B2
(45) Date of Patent: Sep. 12, 2017

(54) EXERCISER

(71) Applicant: Dyaco International Inc., Taipei (TW)

(72) Inventor: Kuo-Wo Hao, Taipei (TW)

(73) Assignee: Dyaco International Inc., Taipei (TW)

( * ) Notice: Subject to any disclaimer, the term of this patent is extended or adjusted under 35 U.S.C. 154(b) by 61 days.

(21) Appl. No.: 14/794,390

(22) Filed: Jul. 8, 2015

(65) Prior Publication Data

US 2016/0354628 A1 Dec. 8, 2016

(30) Foreign Application Priority Data

Jun. 5, 2015 (TW) ..... 104118414 A

(51) Int. Cl.
*A63B 21/02* (2006.01)
*A63B 23/04* (2006.01)
(Continued)

(52) U.S. Cl.
CPC ..... *A63B 21/023* (2013.01); *A63B 21/0421* (2013.01); *A63B 21/4033* (2015.10);
(Continued)

(58) Field of Classification Search
CPC ..... A63B 21/00061; A63B 21/00072; A63B 21/023; A63B 21/0421; A63B 21/045; A63B 21/05; A63B 21/055; A63B 21/159; A63B 21/4033; A63B 21/4035; A63B 21/4047; A63B 23/035; A63B 23/03533; A63B 23/0355; A63B 23/0482; A63B 23/0488; A63B 23/1245; A63B 23/14; A63B 23/16; A63B 71/0054; A63B 2225/09
See application file for complete search history.

(56) References Cited

U.S. PATENT DOCUMENTS 2,261,173 A * 11/1941 Maxwell ..... A63B 21/00072 482/129
4,210,323 A * 7/1980 Feather ..... A63B 21/0004 482/122
(Continued)

FOREIGN PATENT DOCUMENTS

| | | |
|---|---|---|
| TW | 303698 U | 4/1997 |
| TW | M330845 U | 4/2008 |
| WO | WO 2011/021028 A1 | 2/2011 |

OTHER PUBLICATIONS

Office Action Dated Aug. 15, 2016 in corresponding Taiwan Patent Application No. 104118414.

*Primary Examiner* — Joshua Lee
(74) *Attorney, Agent, or Firm* — Donald E. Stout; Stout, Uxa & Buyan, LLP

(57) ABSTRACT

An exerciser comprises a first block, a second block, a first torque member, a second torque member, and a damper assembly. The first block has an axle pivotally coupling with the second block. The first torque member is arranged at a first position or a second position of the first block. The second torque member is arranged at a first position and a second position of the second block. The damper assembly couples with the first block and a second block. The forces exerted on the first torque member and the second torque member will increase or decrease the distance between the first torque member and the second torque member.

6 Claims, 5 Drawing Sheets

(51) Int. Cl.

| | |
|---|---|
| ***A63B 21/04*** | (2006.01) |
| ***A63B 23/035*** | (2006.01) |
| *A63B 71/00* | (2006.01) |
| *A63B 21/05* | (2006.01) |
| *A63B 21/055* | (2006.01) |
| *A63B 23/12* | (2006.01) |
| *A63B 23/16* | (2006.01) |
| *A63B 21/00* | (2006.01) |

(52) U.S. Cl.

CPC .... *A63B 23/0355* (2013.01); *A63B 23/03533* (2013.01); *A63B 23/0482* (2013.01); *A63B 21/00061* (2013.01); *A63B 21/00072* (2013.01); *A63B 21/05* (2013.01); *A63B 21/055* (2013.01); *A63B 21/4035* (2015.10); *A63B 23/0488* (2013.01); *A63B 23/1245* (2013.01); *A63B 23/16* (2013.01); *A63B 71/0054* (2013.01); *A63B 2225/09* (2013.01)

(56) References Cited

U.S. PATENT DOCUMENTS 4,629,186 A * 12/1986 Aldridge ..... A63B 21/0004 482/126
5,042,799 A * 8/1991 Stanley ..... A63B 21/0004 482/112
5,413,548 A * 5/1995 Hoffman ..... A63B 21/4047 482/121
5,507,712 A * 4/1996 Chang ..... A63B 21/0004 482/126
5,674,164 A * 10/1997 Kravitz ..... A63B 21/0004 482/121
5,690,596 A * 11/1997 Parker ..... A63B 21/0004 482/121
5,720,701 A * 2/1998 Truini ..... A63B 21/0004 482/122
6,013,010 A * 1/2000 Farsaie ..... A63B 21/0004 482/118
6,080,090 A * 6/2000 Taylor ..... A63B 21/0455 482/121
6,773,378 B2 * 8/2004 Bastyr ..... A63B 21/0004 482/114
8,790,227 B2 * 7/2014 Meister ..... A63B 23/0494 482/140
9,211,430 B1 * 12/2015 Higginbotham, III ..... A63B 21/0004
9,278,244 B2 * 3/2016 Chuang ..... A63B 21/055
2004/0003687 A1 * 1/2004 An ..... A63B 21/0004 81/427
2005/0233878 A1 * 10/2005 Wen ..... A63B 21/0004 482/127
2010/0160119 A1 * 6/2010 O'Connor ..... A63B 21/012 482/45
2014/0187395 A1 * 7/2014 Blahnik ..... A63B 21/00069 482/141
2015/0290491 A1 * 10/2015 An ..... A63B 23/16 482/49
2016/0310816 A1 * 10/2016 Horne ..... A63B 69/3641

* cited by examiner

EXERCISER

CROSS-REFERENCE TO RELATED APPLICATIONS

The entire contents of Taiwan Patent Application No. 104118414, filed on Jun. 5, 2015, from which this application claims priority, are expressly incorporated herein by reference.

BACKGROUND OF THE INVENTION

1. Field of the Invention

The present invention relates to an exerciser, and more particularly relates to an exerciser providing multiple training ways.

2. Description of Related Art

U.S. Pat. No. 7,316,635 discloses a thigh exerciser. An assembly of a seat member, a backrest, and four legs constitutes a chair. A user sits on the chair and a first swing rod and a second swing rod are between his or her two thighs. A linkage interconnects the first swing rod and the second swing rod. The first and second swing rods are connected with a biasing damper and are pivotally connected to the seat member by a vertical pivot rod. A thigh-engaging portion of the first and second swing rods is disposed outwardly of the seat member. The user exerts a force to the thigh-engaging portion of the first and second swing rods, such that the thighs can be trained.

The conventional thigh exerciser however can merely train the inner portion of the thigh, and the outer portion of the thigh cannot be trained. In other words, the conventional thigh exerciser can merely train in one direction.

SUMMARY OF THE INVENTION

In one general aspect, the present invention relates to an exerciser, and more particularly relates to an exerciser configured to train variant portions, such as thighs limbs, and arms, in two directions.

According to an embodiment of the present invention, an exerciser is provided with a first block, a second block, a damper assembly, a first torque member, and a second torque member. The second block pivotally couples with an axle of the first block. The first block is capable of rotating around the axle in a first direction, and the second block is capable of rotating around the axle in a second direction opposite to the first direction. The damper assembly couples with the first block and the second block, and the damper assembly provides a resistance while the first block and the second block are rotated. The first torque member couples with the first block so that the first torque member is arranged at a first position or a second position of the first block. The second torque member couples with the second block so that the second torque member is arranged at a first position or a second position of the second block. Whereby a force is exerted at the first torque member and the second torque member to decrease or increase a distance between the first torque member and the second toque member.

In an embodiment, the first block further comprises a first fixing member, and the first torque member couples with the first block via the first fixing member, so that the first torque member is arranged at the first position or the second position of the first block. In addition, the second block further comprises a second fixing member, and the second torque member couples with the second block via the second fixing member, so that the second torque member is arranged at the first position or the second position of the second block.

In an embodiment, the first block further comprises a first recess and a second recess, and the first fixing member is selectively placed in the first recess or the second recess of the first block, so that the first torque member is arranged at the first position or the second position of the first block. In addition, the second block further comprises a first recess and a second recess, and the second fixing member is selectively placed in the first recess or the second recess of the second block, so that the second torque member is arranged at the first position or the second position of the second block.

In an embodiment, both the first fixing member and the second fixing member are detachable bolts.

In an embodiment, the first block further comprises a first axle, the second block further comprises a second axle, an end of the first torque member pivotally couples with the first axle, and an end of the second torque member pivotally couples with the second axle.

In an embodiment, the first torque member comprises one or more first protrusions to be inserted into or fit with one or more corresponding recesses of the first block, so that the first torque member is arranged at the first position or the second position of the first block, and the second torque member comprises one or more second protrusions to be inserted into or fit with one or more corresponding recesses of the second block, so that the second torque member is arranged at the first position or the second position of the second block.

In an embodiment, the damper assembly comprises a spring having a first end and a second end, in which the first end couples with the first block, and the second end couples with the second block.

In an embodiment, the damper assembly further comprises a movable block, a screw, and a knob arranged at the first block. Wherein the first end couples with the movable block, the movable block has internally thread to engage with the screw, the screw couples with the knob, and the rotation of the knob will drive the movable block moving along the screw.

According to another embodiment of the present invention, an exerciser is provided with a first block, a second block, a damper assembly, a first torque member, and a second torque member. The second block pivotally couples with an axle of the first block. The first block is capable of rotating around the axle in a first direction, and the second block is capable of rotating around the axle in a second direction opposite to the first direction. The damper assembly couples with the first block and the second block, and provides a resistance while the first block and the second block are rotated. The first torque member has a first portion and a second portion, wherein the first torque member couples with the first block so that the first portion of the first torque member is arranged at a first position of the first block and the second portion of the first torque member is arranged at a second position of the first block. The second torque member has a first portion and a second portion, wherein the second torque member couples with the second block so that the first portion of the second torque member is arranged at a first position of the second block and the second portion of the second torque member is arranged at a second position of the second block. Whereby a first force is exerted at the first portion of the first torque member and the first portion of the second torque member to decrease a distance between the first torque member and the second toque member, and a second force is exerted at the second portion of the first torque member and the second portion of the second torque member to increase the distance between the first torque member and the second toque member.

DETAILED DESCRIPTION OF THE PREFERRED EMBODIMENT

Figure 1A:
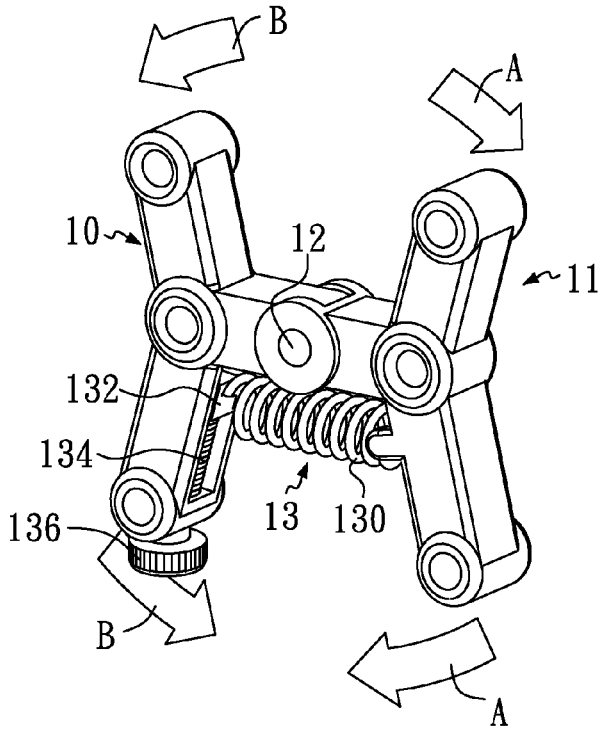
FIGS. 1A and 1B are front view showing a movement structure of an exerciser according to a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 1B:
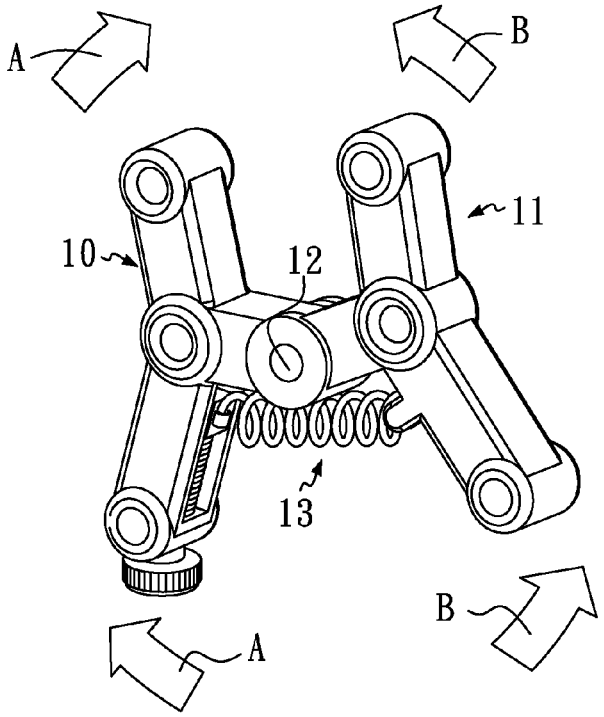

FIGS. 1A and 1B are front views showing a movement structure of an exerciser in accordance with a preferred embodiment of the present invention.

As shown in FIGS. 1A and 1B, the movement structure comprises a first block 10 and a second block 11. The central zone of the first block 10 may include an axle 12 pivotally connected with the second block 11, so that the first block 10 can rotate around the axle 12 in a first direction, and the second block 11 can rotate around the axle 12 in a second direction opposite to the first direction. Referring to FIG. 1A, the first block 10 rotates in a counterclockwise direction B, and the second block 11 rotates in a clockwise direction A. Referring to FIG. 1B, the first block 10 rotates in a clockwise direction A, and the second block 11 rotates in a counterclockwise direction B.

As shown in FIGS. 1A and 1B, the movement structure of the exerciser may further comprise a damper assembly 13. The damper assembly 13 couples with the first block 10 and the second block 11, and provides a resistance while the first block 10 and the second block 11 are rotated.

The detail of the damper assembly 13 should not be limited. Referring to FIGS. 1A and 1B, preferably, the damper assembly 13 comprises a spring 130 having two ends, in which one end couples with the first block 10, and the other end couples with the second block 11.

Preferably, the resistance provided by the damper assembly 13 can be adjusted. Referring to FIGS. 1A and 1B, preferably, the damper assembly 13 may further comprise a movable block 132, a screw 134, and a knob 136 arranged at the first block 10 (the movable block 132, the screw 134, and the knob 136 can also be arranged at the second block 10 in another embodiment of the present invention). One end of the spring 130 couples with the second block 11, and the other end of the spring 130 couples with the movable block 132. The movable block 132 is internally threaded to engage with the screw 134, which couples with the knob 136. The rotation of the knob 136 can drive the movable block 132 moving along the screw 134 so as to change the angle of the spring 130 and thus change the resistance.

Notice that the movement structure as disclosed in FIGS. 1A and 1B is the inventive concept, and the movement structure may have different appearances.

Figure 2:
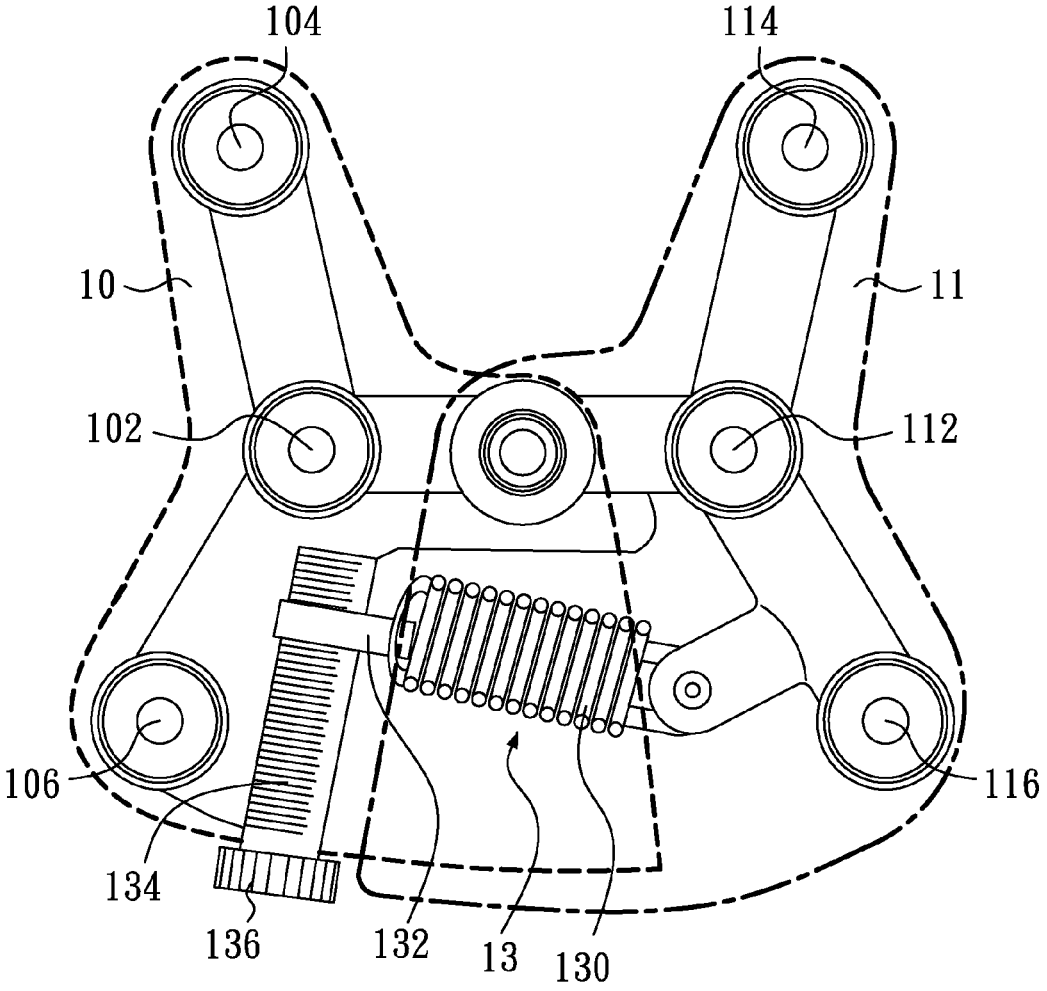
FIG. 2 is a cross-sectional simplified view showing another movement structure of an exerciser according to another embodiment of the present invention.

FIG. 2 illustrates a movement structure according to another embodiment of the present invention. Referring to FIG. 2, the movement structure comprises a first block 10, a second block 11, and a damper assembly 13 having same functions as discussed before. In addition, the first block 10 and the second block 11 may be partially overlapped, so that the first block 10 and the second block 11 can encompass the spring 130 of the damper assembly 13 while the movement structure is operated, and thus the safety can be ensured.

Figure 3A:
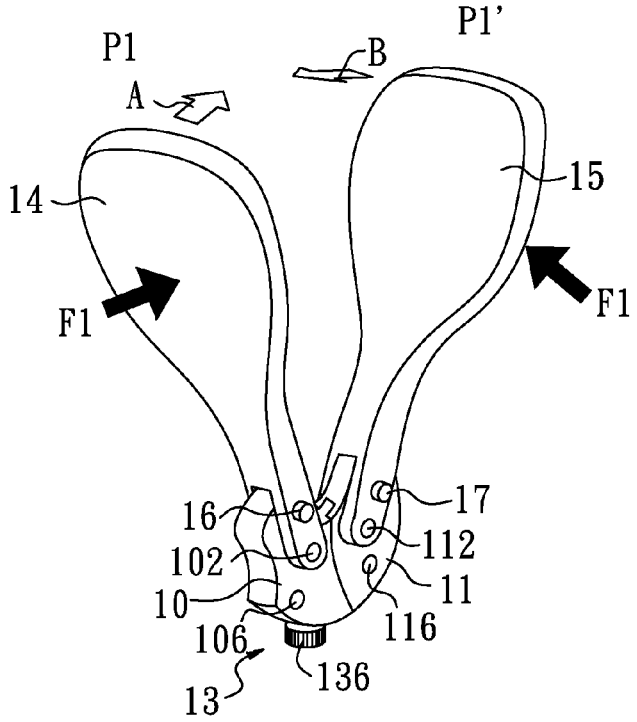
FIGS. 3A and 3B are front view showing an exerciser according to a preferred embodiment of the present invention.
Figure 3B:
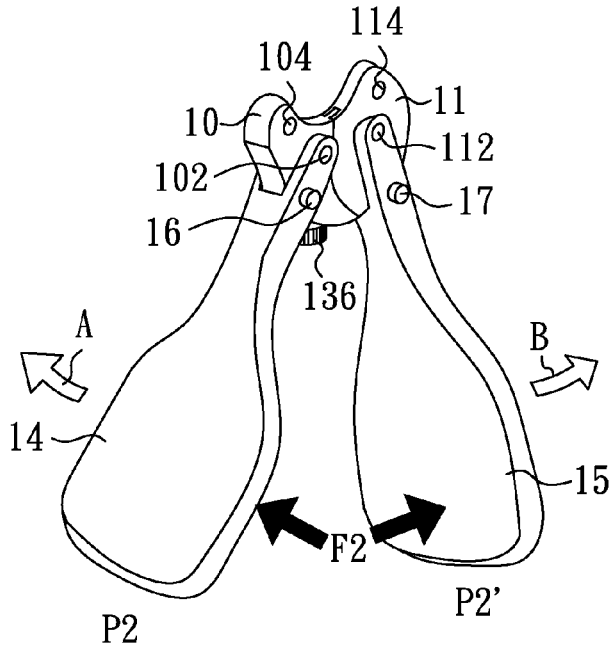

FIGS. 3A and 3B are front views showing an exerciser 1 according to a preferred embodiment of the present invention. In this embodiment, the exerciser 1 employs the movement structure of FIG. 2. However, the exerciser 1 may also employ the movement structure as shown in FIGS. 1A and 1B. As shown in FIG. 2, FIG. 3A, and FIG. 3B, the exerciser 1 comprises the first block 10, the second block 11, and the damper assembly 13 as mentioned above. In addition, the exerciser 1 further comprises a first torque member 14 and a second torque 15 respectively coupling with the first block 10 and the second block 11. The first torque member 14 couples with the first block 10, so that the first torque member 14 is arranged at a first position P1 of the first block 10, e.g., the upper position of the first block 10. Alternatively, the first torque member 14 couples with the first block 10, so that the first torque member 14 is arranged at a second position P2 of the first block 10, e.g., the lower position of the first block 10. The second torque member 15 couples with the second block 11, so that the second torque member 15 is arranged at a first position P1' of the second block 11, e.g., the upper position of the second block 11. Alternatively, the second torque member 15 couples with the second block 11, so that the second torque member 15 is arranged at a second position P2' of the second block 11, e.g., the lower position of the second block 11.

Referring to FIG. 3A, the first torque member 14 is arranged at the first position P1 of the first block 10, and the second torque member 15 is arranged at the first position P1' of the second block 11. By this arrangement, the user can put the first torque member 14 and the second torque member 15 between two arms, limbs, or thighs, and the arms, limbs, or thighs exert a force F1 to compress the first torque member 14 and the torque member 15, so as to decrease the distance between the first torque member 14 and the second torque member 15. Alternatively, the user may put the first torque member 14 and the second torque member 15 between the upper limb and the body, and the upper limb exerts a force F1 to compress the first torque member 14 and the second torque member 15, so as to decrease the distance between the first torque member 14 and the second torque member 15, so as to train the upper limb.

Referring to FIG. 3B, the first torque member 14 is arranged at the second position P2 of the first block 10, and the second torque member 15 is arranged at the second position P2' of the second block 11. By this arrangement, the user can put the first torque member 14 and the second torque member 15 at the outside of two arms, limbs, or thighs. The arms, limbs, or thighs exert a force F2 to expand the first torque member 14 and the second torque member 15, so as to increase the distance between the first torque member 14 and the second torque member 15.

The shape of the first torque member 14 and the second torque member 15 is not limited. Preferably, the shape of the first torque member 14 and the second torque member 15 is ergonomic. As shown in FIGS. 3A and 3B, the shape of the first torque member 14 and the second torque member 15 is suitable for limb or thigh.

In addition, the first torque member 14 and the second torque member 15 may couple with the first block 10 and the second block 11 via fixing member, fitting, insertion, screw, and the likes, so that the first torque 14 and the second torque member 15 can be arranged at the first position P1/P1' or the second position P2/P2' of the first block 10 and the second block 11, respectively.

Referring to FIGS. 2, 3A, and 3B, the first torque member 14 may couple with the first block 10 via a first fixing member 16, so that the first torque member 14 is arranged at the first position P1 or the second position P2 of the first block 10. Preferably, the first fixing member 16 is a first detachable bolt 16, and the first block 10 may further comprise a first axle 102, a first recess 104, and a second recess 106. In particular, an end of the first torque member 14 pivotally couples with the first axle 102, and the first detachable bolt 16 can be selectively placed into the first recess 104 or the second recess 106, so that the first torque member 14 is arranged at the first position P1 or the second position P2 of the first block 10.

Referring to FIGS. 2, 3A, and 3B, the second torque member 15 may couple with the second block 11 via a second fixing member 17, so that the second torque member 15 is arranged at the first position P1' or the second position P2' of the second block 11. Preferably, the second fixing member 17 is a second detachable bolt 17, and the second block 11 may further comprise a second axle 112, a first recess 114, and a second recess 116. In particular, an end of the second torque member 15 pivotally couples with the second axle 112, and the second detachable bolt 17 can be selectively placed into the first recess 114 or the second recess 116, so that the second torque member 15 is arranged at the first position P1' or the second position P2' of the second block 11.

By the first detachable bolt 16, the second detachable bolt 17, the first axle 102, and the second axle 112, the user can conveniently alter the training ways of the exerciser 1, i.e., compressing or expanding, so as to train different muscles. However, the first fixing member 16 and the second fixing member 17 could be other components known in the art, e.g., screw, instead of the detachable bolt. And in another embodiment of the present invention, the first axle 102 and the second axle 112 may be omitted.

Figure 4A:
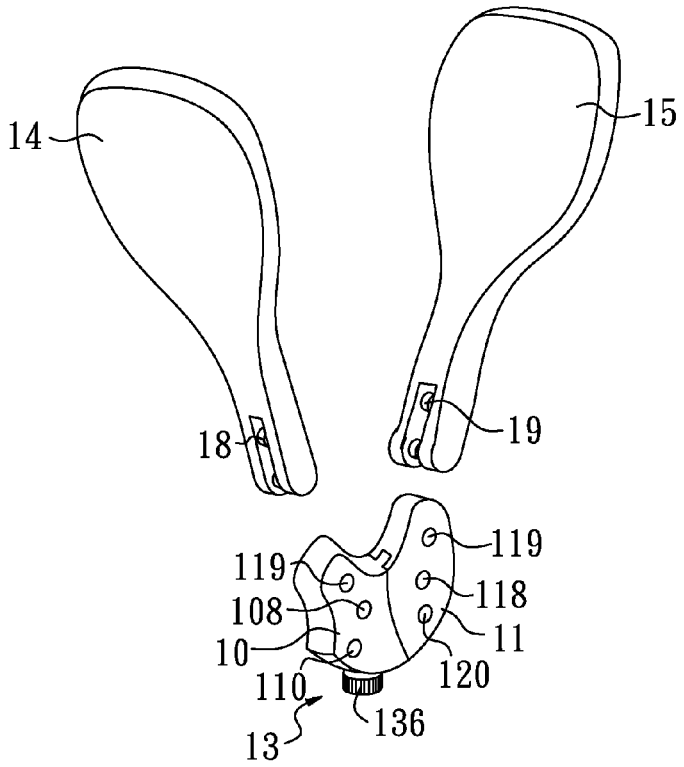
FIGS. 4A and 4B are front view showing an exerciser according to another embodiment of the present invention.
Figure 4B:
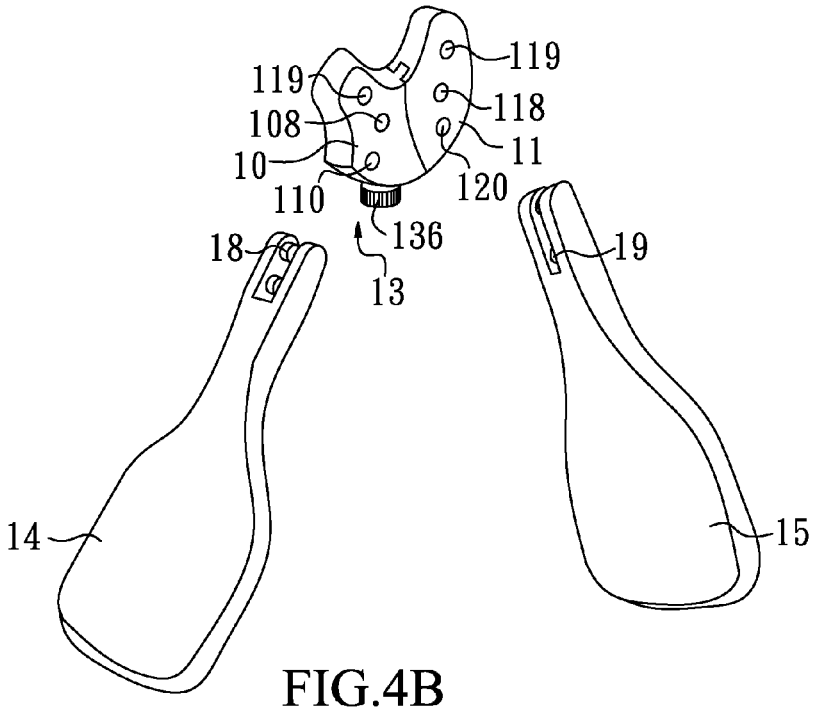

FIGS. 4A and 4B show an exerciser 2 according to another embodiment of the present invention. The exerciser 2 also comprises the first block 10, the second block 11, and the damper assembly 13 as mentioned above. The exerciser 2 differs from the exerciser 1 in that the first torque member 14 and the second torque member 15 of the exerciser 2 respectively couple with the first block 10 and the second block 11 via insertion or tight fitting instead of the first fixing member 16 and the second fixing member 17. For example, the first torque member 14 may comprises one or more first protrusions 18, which can insert into or fit with one or more corresponding recesses of the first block 10. For example, when two first torque protrusions 18 are inserted into the central recess 108 and a first recess 109 respectively, the first torque member 14 is arranged at the first position P1 of the first block 10; when two first torque protrusions 18 are inserted into the central recess 108 and a second recess 110 respectively, the first torque member 14 is arranged at the second position P2 of the first block 10.

Similarly, the second torque member 15 may comprises one or more second protrusions 19, which can insert into or fit with one or more corresponding recesses of the second block 11. For example, when two second torque protrusions 19 are inserted into the central recess 118 and a first recess 119 respectively, the second torque member 15 is arranged at the first position P1' of the second block 11; when two second torque protrusions 19 are inserted into the central recess 118 and a second recess 120 respectively, the second torque member 15 is arranged at the second position P2' of the second block 11. The first torque member 14 and the second torque member 15 may be made of an elastic material for helping the assembling.

Figure 5:
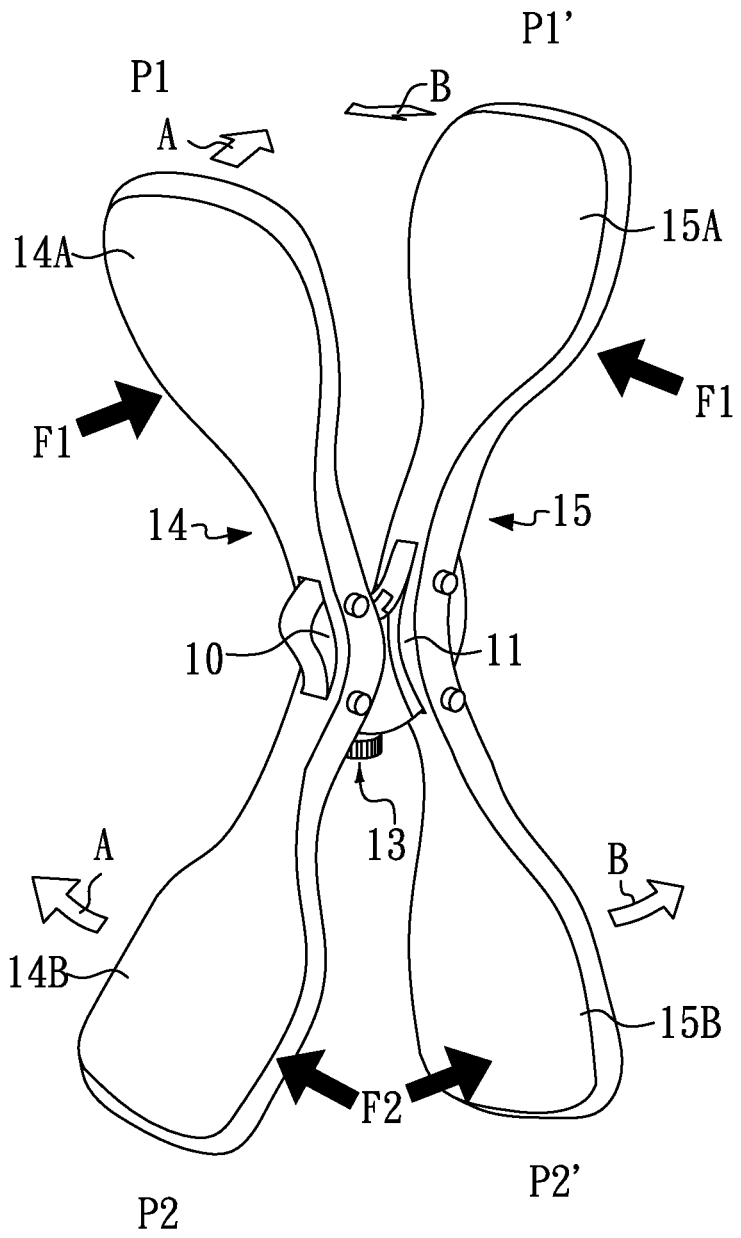
FIG. 5 is a front view showing an exerciser according to another embodiment of the present invention.

FIG. 5 is a front view showing an exerciser 3 according to another embodiment of the present invention. The exerciser 3 comprises the above-mentioned first block 10, the second block 11, and the damper assembly 13. The difference is that the first torque member 14 of the exerciser 3 includes a first portion 14A and a second portion 14B, where the first torque member 14 couples with the first block 10 so that the first portion 14A is arranged at the first position P1 of the first block 10, and the second portion 14B is arranged at the second position P2 of the first block 10.

In addition, the second torque member 15 of the exerciser 3 includes a first portion 15A and a second portion 15B, where the first torque member 15 couples with the second block 11 so that the first portion 15A is arranged at the first position P1' of the second block 11, and the second portion 15B is arranged at the second position P2' of the second block 10.

The coupling between the first torque member 14 and the first block 10 and the coupling between the second torque member 15 and the second block 11 may be achieved by the above-mentioned fixing members, detachable bolts, insertion, fitting, screws, and the likes. When the force F1 is exerted at the first portion 14A of the first torque member 14 and the first portion 15A of the second torque member 15, the distance between the first torque member 14 and the second torque member 15 is decreased. When the force F2 is exerted at the second portion 14B of the first torque member 14 and the second portion 15B of the second torque member 15, the distance between the first torque member 14 and the second torque member 15 is increased. In one embodiment of the present invention, the first torque member 14 and the first block 10 are integrally formed, and the second torque member 15 and the second block 11 are integrally formed.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exerciser, comprising:

a first block;

a second block pivotally coupled with an axle of the first block, the first block being capable of rotating around the axle in a first direction, the second block being capable of rotating around the axle in a second direction opposite to the first direction;

a damper assembly coupled with the first block and the second block, the damper assembly providing a resistance while the first block and the second block are rotated;

a first torque member coupled with the first block so that the first torque member is arranged at a first position or a second position of the first block;

a second torque member coupled with the second block so that the second torque member is arranged at a first position or a second position of the second block;

the first block further comprising a first fixing member and a first axle, the first torque member coupling with the first block via the first fixing member, and an end of the first torque member pivotally coupling with the first axle, so that the first torque member is arranged at the first position or the second position of the first block; and the second block further comprising a second fixing member and a second axle, the second torque member coupling with the second block via the second fixing member, and an end of the second torque member pivotally coupling with the second axle, so that the second torque member is arranged at the first position or the second position of the second block;

whereby a force is exerted at the first torque member and the second torque member to decrease or increase a distance between the first torque member and the second torque member.

2. The exerciser as recited in claim 1, wherein:

the first block further comprises a first recess and a second recess, and the first fixing member is selectively placed in the first recess or the second recess of the first block, so that the first torque member is arranged at the first position or the second position of the first block; and the second block further comprises a first recess and a second recess, and the second fixing member is selectively placed in the first recess or the second recess of the second block, so that the second torque member is arranged at the first position or the second position of the second block.

3. The exerciser as recited in claim 1, wherein both the first fixing member and the second fixing member are detachable bolts.

4. The exerciser as recited in claim 1, wherein:

the first torque member comprises one or more first protrusions to be inserted into or fit with one or more corresponding recesses of the first block, so that the first torque member is arranged at the first position or the second position of the first block; and the second torque member comprises one or more second protrusions to be inserted into or fit with one or more corresponding recesses of the second block, so that the second torque member is arranged at the first position or the second position of the second block.

5. The exerciser as recited in claim 1, wherein the damper assembly comprises a spring having a first end and a second end, in which the first end couples with the first block, and the second end couples with the second block.

6. The exerciser as recited in claim 5, wherein:

the damper assembly further comprises a movable block, a screw, and a knob arranged at the first block;

the first end of the spring couples with the movable block;

the movable block is internally threaded to engage with the screw;

the screw couples with the knob; and rotation of the knob drives the movable block to move along the screw.

* * * * *